United States Patent [19]

Kuzuya et al.

[11] Patent Number: 5,066,152

[45] Date of Patent: Nov. 19, 1991

[54] RECORDING APPARATUS WITH MECHANISM FOR CUTTING PRINTED TAPE COVERED BY BACKING TAPE

[75] Inventors: Susumu Kuzuya, Gifu; Seiji Shimizu; Mikio Kato, both of Nagoya; Yujiro Ishikawa, Toyota; Takashi Sakai, Nagoya; Eiji Yuki, Owariasahi, all of Japan

[73] Assignee: Brother Kogyo Kabushiki Kaisha, Nagoya, Japan

[21] Appl. No.: 273,984

[22] Filed: Nov. 21, 1988

[30] Foreign Application Priority Data

Nov. 28, 1987 [JP] Japan ..... 62-181307[U]

[51] Int. Cl.[5] ..... B41J 11/68

[52] U.S. Cl. ..... 400/621; 346/24; 83/861; 83/386

[58] Field of Search ..... 400/593, 621, 621.1, 400/621.2, 120; 83/383, 386, 387, 861, 862, 865; 101/224, 226, 227, 288; 156/510; 346/24

[56] References Cited

U.S. PATENT DOCUMENTS

| | | | |
|---|---|---|---|
| 3,360,093 | 12/1967 | McDonald et al. | 400/621 |
| 3,366,212 | 1/1968 | McInnis | 400/621 |
| 3,372,787 | 3/1968 | Humphrey et al. | 400/621 |
| 3,587,810 | 6/1971 | Alper | 400/621 |
| 3,854,229 | 12/1974 | Morgan | 40/638 |
| 4,179,962 | 12/1979 | Crump | 83/300 |
| 4,407,179 | 10/1983 | Iwase et al. | 83/865 |
| 4,488,466 | 12/1984 | Jones | 83/386 |

FOREIGN PATENT DOCUMENTS

| | | | |
|---|---|---|---|
| 62896 | 5/1981 | Japan . | |
| 57-14971 | 1/1982 | Japan . | |
| 116565 | 6/1986 | Japan | 400/621 |
| 1031809 | 6/1966 | United Kingdom | 400/613.2 |
| 1437921 | 6/1976 | United Kingdom | 400/613.2 |

OTHER PUBLICATIONS

IBM Technical Disclosure Bulletin, vol. 26, No. 3A—Aug. 1983, "Multiple Kana/Kanji Conversion Method"; Author: K. Kawai.

*Primary Examiner*—David A. Wiecking
*Attorney, Agent, or Firm*—Oliff & Berridge

[57] ABSTRACT

A recording apparatus having a printing device for printing on a recording tape, a tape feeding device for feeding a multi-layered tape in a longitudinal direction of the multi-layered tape, and a cutter mechanism for cutting the multi-layered tape. The multi-layered tape includes the recording tape printed by the printing device, and a backing tape superposed on the printed length of the recording tape via an adhesive layer provided therebetween. The cutter mechanism is adapted to cut the multi-layered tape into cut segments, such that each cut segment has at least one partial cut formed through only a thickness of the backing tape.

14 Claims, 6 Drawing Sheets

FIG. 10
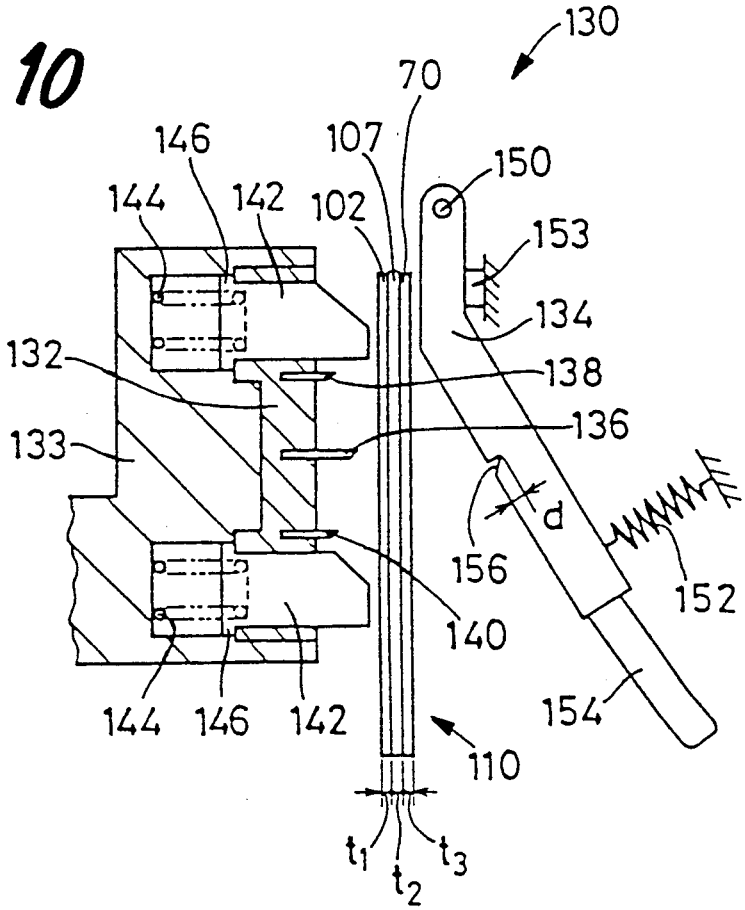
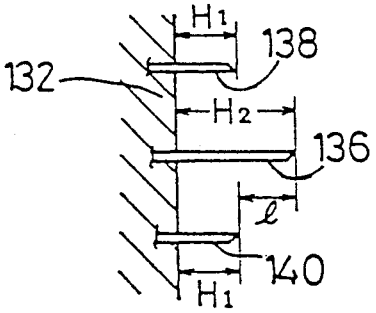
FIG. 11
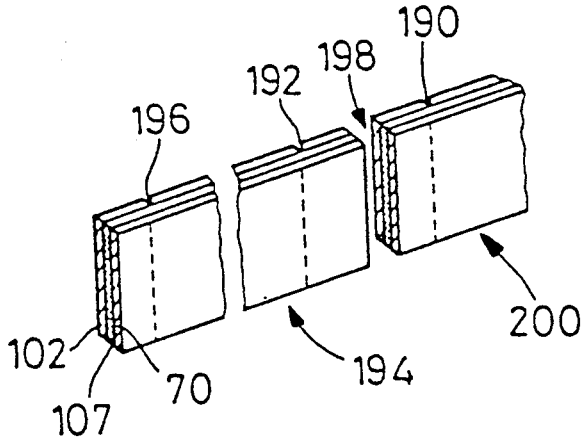
FIG. 13

PHOTOELECTRIC SENSOR
50
CHARACTER ENTRY DIAL
16
20
36
FUNCTION KEYS
CONFIRMATION KEY
160
162
INPUT INTERFACE
164
166
CPU
176
OUTPUT INTERFACE
RAM
170
ROM
168
178
180
PROGRAM MEMORY
DICTIONARY MEMORY
182
HEAD DRIVER CIRCUIT
184
MOTOR DRIVER CIRCUIT
186
DISPLAY DRIVER CIRCUIT
72
THERMAL HEAD
123
TAPE FEEDING MOTOR
22
LIQUID CRYSTAL DISPLAY (LCD)
172
CHARACTER GENERATOR (CG-ROM) FOR PRINTING
174
CHARACTER GENERATOR (CG-ROM) FOR LCD 22

RECORDING APPARATUS WITH MECHANISM FOR CUTTING PRINTED TAPE COVERED BY BACKING TAPE

BACKGROUND OF THE INVENTION

1. Field of the Invention

The present invention relates generally to a recording apparatus adapted to print on a recording tape, and more particularly to such a tape printer equipped with a cutter mechanism for cutting the printed tape covered by a backing or release tape.

2. Discussion of the Prior Art

A tape printer of the type indicated above is known. In one known form of this type of tape printer, a recording tape is covered by a backing or release tape. The covered tape is hereinafter referred to as a multi-layered tape. The leading portion of the multi-layered tape is fed out of the printer body. The backing tape is either bonded to a printed length of the recording tape by means of an adhesive layer provided therebetween or, alternatively, the printing is effected on a multi-layered tape which includes a recording tape and a backing tape bonded to the recording tape. Usually, the printed length of the multi-layered tape is cut into segments, so that the cut segments are used. An example of such a cutter mechanism is illustrated in FIG. 16, wherein a cam pin 212 engaging a movable cutter 214 is oscillated by a drive motor 208 via a gear train 210, whereby the movable cutter 214 is moved toward a stationary cutter 215 so that a multi-layered tape 216 is cut by the cutters 214, 215. To secure the cut segment of the tape 216 to a desired object surface, the corresponding portion of the backing tape is removed from the cut segment, so as to expose the corresponding portion of the adhesive layer.

When the backing tape portion is removed from the cut segment, one of the opposite end portions of the backing tape portion should first be separated from the corresponding end portion of the recording tape, by a finger nail or pincette or tweezers, so that the separated end portion of the backing tape portion is finger-gripped to peel the backing tape portion off the adhesive layer. This procedure for removing the backing tape portion is relatively difficult. Further, when the cut printed tape segment with the exposed adhesive layer is bonded to the object surface by the adhesive, the opposite end portions of the printed tape segment should be finger-gripped to position the segment on the object surface, while stretching the segment. In this instance, the end portions of the adhesive layer tend to stick to the fingers, causing difficulty in separating the fingers from the adhesive layers. Further, finger marks or fingerprints tend to be left on the end portions of the adhesive layer, whereby the appearance of the printed tape segment as bonded to the object surface is deteriorated, particularly where the recording tape is a transparent tape.

SUMMARY OF THE INVENTION

It is accordingly an object of the present invention to provide a recording apparatus for printing on a recording tape, equipped with an improved cutter mechanism which is capable of cutting a multi-layered tape consisting of the printed recording tape and a backing tape, and which assures easy removal of the backing tape and easy attachment of a cut segment of the multi-layered tape on a desired object surface.

The above object may be achieved according to the principle of the present invention, which provides a recording apparatus, comprising a printing device for printing on a recording tape, a tape feeding device for feeding a multi-layered tape in a longitudinal direction of the multi-layered tape, and a cutter mechanism for cutting the multi-layered tape. The multi-layered tape includes a printed length of the recording tape printed by the printing device, and a backing tape superposed on the printed length via an adhesive layer provided therebetween. The cutter mechanism is adapted to cut the multi-layered tape into cut segments, such that each of the cut segments has at least one partial cut formed through only a thickness of the backing tape.

In the recording apparatus of the present invention constructed as described above, each cut segment of the printed multi-layered tape has at least one partial cut formed through the thickness of only the backing tape portion. Consequently, the backing tape portion is divided into at least two divisions. When the cut segment is bent at the partial cut, the end portions of the divisions of the backing tape portion which are adjacent to the partial cut are separated from the printed tape segment. Consequently, the backing tape portion may be easily removed from the printed tape segment, without using a finger nail or tweezers.

For enhanced procedure of bonding the cut segment to the desired object surface, one or two divisions of the backing tape portion of the segment is/are finger-gripped to bend the segment at the partial cut or cuts, in order to separate the end portion or portions of the non-gripped division or divisions of the backing tape portion from the printed tape segment. The non-gripped division or divisions is/are first removed, to expose the corresponding portion of the adhesive layer and position the printed tape segment on the object surface at the exposed portion of the adhesive layer. Then, the finger or fingers is/are released from the gripped division or divisions of the backing tape portion, to remove this or these divisions and bond the printed tape segment over their entire length on the object surface. This procedure permits the tape segment to be suitably bonded to the object surface, without the fingers contacting the adhesive layer.

In one form of the present invention, the cutter mechanism comprises a completely cutting blade disposed so as to face the backing tape of the multi-layered tape, for cutting the multi-layered tape through an entire thickness thereof to produce the cut segments, at least one partially cutting blade disposed on at least one of opposite sides of the completely cutting blade, in spaced-apart relation with the completely cutting blade in a direction of feed of the multi-layered tape, so as to face the backing tape, a cutter holder for supporting the completely and partially cutting blades, and a cutting-motion imparting mechanism for effecting a relative movement between the cutter holder and the multi-layered tape. Each partially cutting blade has a cutting edge which is spaced from a cutting edge of the completely cutting blade in a direction away from the backing tape, so that each partially cutting blade cuts only the backing tape when the completely cutting blade cuts the multi-layered tape through the entire thickness thereof. The cutter holder supports the completely and partially cutting blades such that the cutting blades are immovable relative to each other. The cutting-motion imparting mechanism enables the completely cutting blade and the above-indicated at least one partially cutting blade to concurrently cut the multi-layered tape and the backing tape, respectively, such that the partial cut or cuts is/are formed in each cut segment.

However, the cutter mechanism may use only one cutting blade. In this case, the depth of cut of the cutting blade is changed for a complete cut of the multi-layered tape and a partial cut or cuts of the backing tape only. For example, a partial cut is effected after the leading end portion of the multi-layered tape is fed a suitable distance, and a complete cut is accomplished after the leading end portion of the tape is fed a predetermined further distance.

In one arrangement of the above form of the invention, the cutting-motion imparting mechanism comprises a support member disposed on one of opposite sides of the multi-layered tape remote from the cutter holder. The support member and the cutting holder are movable toward each other to move the cutter holder and the multi-layered tape toward each other such that the support member supports the multi-layered tape on the above-indicated one side of the multi-layered tape, when the completely and partially cutting blades cut the multi-layered tape and the backing tape, respectively.

In the above arrangement, the cutter holder may be a stationary member. In this case, the support member may be a member which is supported pivotally about an axis perpendicular to the direction of feed of the multi-layered tape, so as to move toward the cutter holder.

In the same arrangement of the invention, the cutting-motion imparting mechanism may further comprise biasing means for biasing the support member in a direction away from the cutter holder, and an operating member for moving the support member toward the cutter holder against a biasing action of the biasing means.

According to another feature of the same arrangement, the cutting-motion imparting means may further comprise a presser member which is supported by the cutter holder such that the support member acts on the multi-layered tape at two positions which are located upstream and downstream of the completely and partially cutting blades. The presser member is movable between an advanced position thereof in which the presser member protrudes a larger distance than the blades, and a retracted position thereof in which the presser member protrudes a smaller distance than the blades. The presser member is biased toward the advanced position by suitable biasing means. The presser member is adapted to urge or force the multi-layered tape against the support member at the two positions, prior to cutting of the multi-layered tape and the backing tape by the support member and the completely and partially cutting blades.

In another form of the invention, the cutter mechanism comprises a completely cutting blade disposed so as to face the backing tape of the multi-layered tape, for cutting the multi-layered tape through an entire thickness thereof to produce the cut segments, and two partially cutting blades disposed on opposite sides of the completely cutting blade, respectively, in spaced-apart relation with each other in a direction of feed of the multi-layered tape, so as to cut only the backing tape when the completely cutting blade cuts the multi-layered tape through the entire thickness thereof. In this case, the backing tape portion of the cut segment is divided into three divisions by the two partial cuts. Accordingly, only the cut segment may be easily positioned on the object surface such that only the portion of the adhesive layer corresponding to the removed central division of the back tape portion is exposed, while the end portions of the segment is finger-gripped. The two partially cutting blades may be spaced apart from the completely cutting blade by a same distance in the direction of feed of the multi-layered tape. It is desirable that the two partially cutting blades be positioned so that the two partial cuts are formed relatively adjacent to the opposite ends of each cut segment of the multi-layered tape.

In a further form of the invention, the tape feeding device comprises a drive source for feeding the multi-layered tape, and control means for controlling the drive source so as to feed the multi-layered tape in the direction of feed until a part of the multi-layered tape a predetermined length spaced away from a last imprint printed on the recording tape in the direction of feed reaches a cutting position aligned with the completely cutting blade. The control means turns off the drive source when the part of the multi-layered tape reaches the cutting position.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which:

FIG. 10 is a plan view of a cutter mechanism incorporated in the tape printer;

FIG. 11 is a plan view showing a cutting blade arrangement of the cutter mechanism of FIG. 10;

FIG. 13 is a perspective view of a segment of the printed tape obtained by cutting the tape by the cutter mechanism of FIG. 10;

DETAILED DESCRIPTION OF THE PREFERRED EMBODIMENTS

Figure 1:
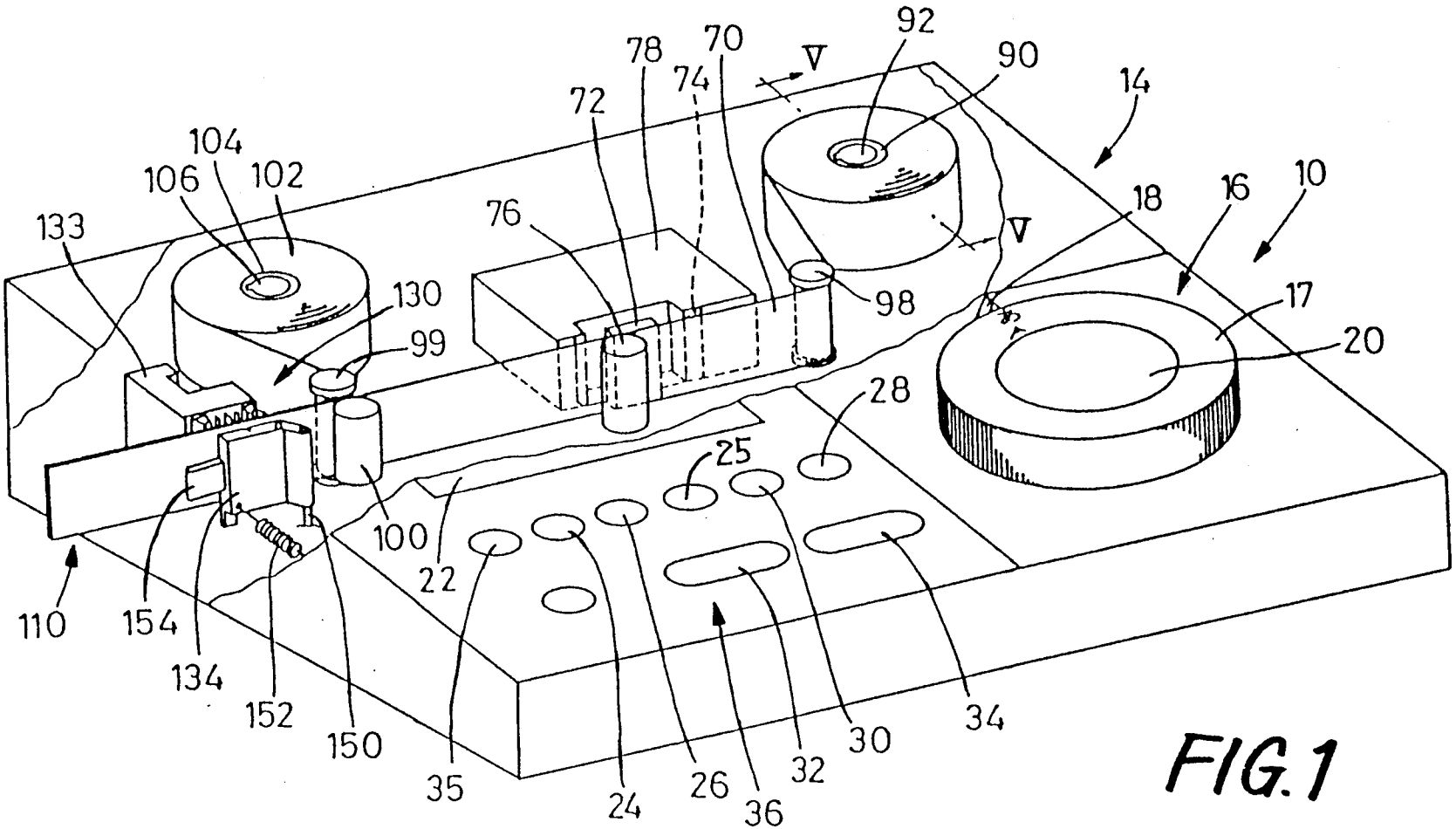
FIG. 1 is a perspective view of one embodiment of a recording apparatus of the present invention in the form of a tape printer.

Referring first to FIG. 1, there is shown a general arrangement of the tape printer according to one embodiment of the invention. The tape printer has a front section incorporating a data input section 10, and a rear section incorporating a printing section 14 adapted to effect printing according to input data entered through the data input section 10. The data input section 10 has a data entry member in the form of a character entry dial 16 which is rotatable to enter desired characters to be printed. The character entry dial 16 assumes an annular shape, and has an annular indicator surface 17 on which are provided two circular rows of indicia such that the indicia of each row are equally spaced apart from each other along the annulus of the indicator surface 17. The indicia represent a multiplicity of characters such as letters (Japanese "kana" letters, English alphabetic letters and numerals), symbols and graphic representations.

The data input section 10 further has a pointer 18 disposed adjacent to the outer circumference of the character entry dial 16. The pointer 18 is used to zero the dial 16, and position the dial 16 for selecting the desired character. Inside the character entry dial 16, there is concentrically disposed a CONFIRMATION key 20 which is operated to enter the selected character. When one of the two characters of the outer and inner rows of indicia which are aligned with the pointer 18 is desired, the CONFIRMATION key 20 is operated, together with an OUT/IN selector key 25. As a result, the character of the outer or inner row of indicia selected by the OUT/IN selector key 25 is selected and entered as the desired character. The currently designated characters aligned with the pointer 18 are sequentially indicated on a liquid crystal display 22 provided on the data input section 10.

The data input section 10 further has various function keys 36 disposed adjacent to the character entry dial 16. The function keys 36 include a SPACING selector key 24 for designating the spacing between successive characters to be printed, the above-indicated OUT/IN selector key 25, a SIZE selector key 26 for designating the size of the character, an INSERT key 28, a DELETE key 30, a KANA/CHINESE CHARACTER conversion key 32 for converting an entered "kana" word, as known in the art, into a Chinese character word, a SEARCH key 34 for searching and designating a desired Chinese character or word, and a PRINT key 35 for effecting the printing of the entered data.

There will next be described in detail the character entry dial 16 and the CONFIRMATION key 20.

Figure 2:
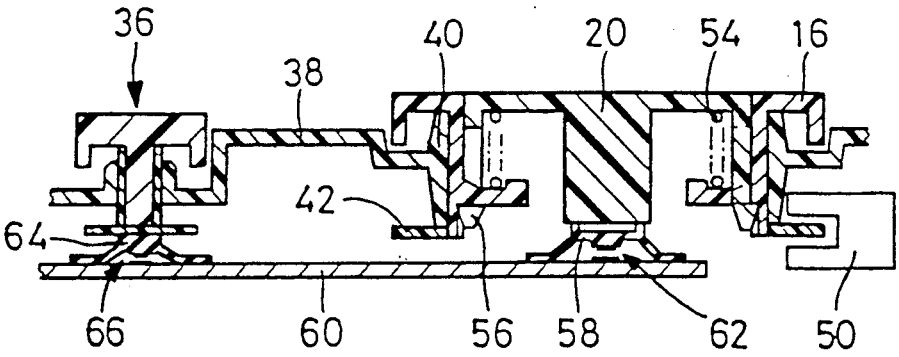
FIG. 2 is an elevational view in cross section of a character entry dial and its vicinity.

As shown in FIG. 2, the character entry dial 16 is rotatably supported within a cylindrical portion 40 of a covering 38 which forms a part of the apparatus body 12. The dial 16 has an upper operating portion which protrudes from the covering 38. A slit disc 42 is secured to the lower end of the character entry dial 16 such that the disc 42 is concentric with the dial 16.

Figure 3:
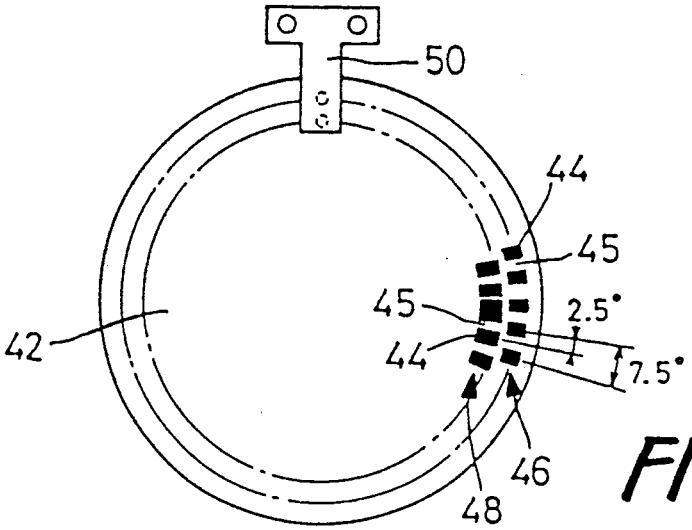
FIG. 3 is a fragmentary plan view of the arrangement of FIG. 2.
Figure 4:
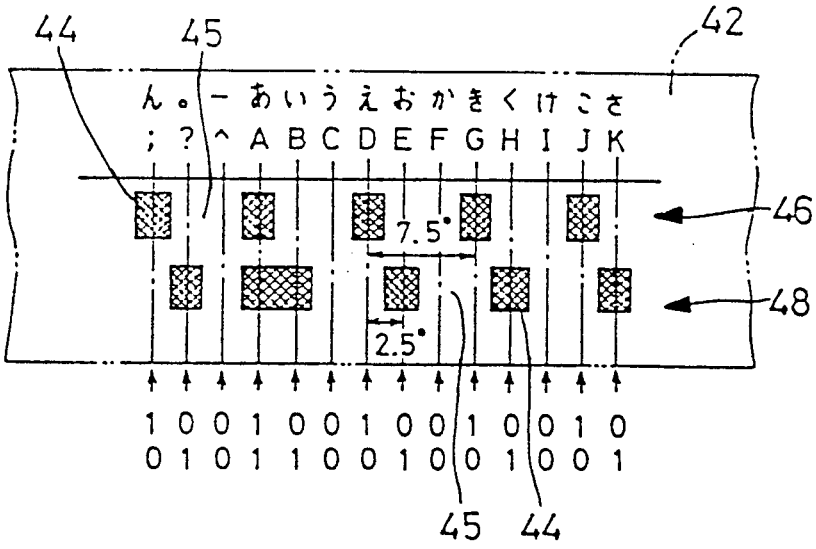
FIG. 4 is a schematic representation illustrating a portion of an optical grid arrangement of the character entry dial, when viewed linearly, in connection with the states of detection signals obtained by a photoelectric sensor.

As indicated in FIG. 3, the slit disc 42 has a circular optical grid arrangement formed by silk-screen printing. The optical grid arrangement has optically opaque grids 44, and optically transparent slits 45 formed between the adjacent opaque grids 44. A portion of this optical grid arrangement is illustrated in FIG. 4, in which actually circular outer and inner rows 46, 48 of the grids and slits 44, 45 are shown so as to extend linearly, for convenience' sake. The outer row 46 is adapted to detect the angular phase of the character entry dial 16, while the inner row 48 is adapted to detect the rotating direction of the dial 16. In the present embodiment, the grids 44 of the outer row 46 are evenly spaced apart from each other at an angular interval of 7.5°, and the grids 44 of the inner row 48 are offset from the corresponding grids 44 of the outer row 46 by an angle of 2.5° in the clockwise direction as viewed in FIG. 3. A photoelectric sensor 50 for optically detecting the grids and slits 44, 45 of the outer and inner rows 46, 48 is provided such that a light-emitting element on one side of the sensor 50 and a light-sensitive element on the other side of the sensor are positioned on the opposite surfaces of the slit disc 42, as indicated in FIG. 2.

The photoelectric sensor 50 is adapted to produce a signal "1" for each grid 44, and a signal "0" for each slit 45. These signals are applied to a microcomputer of a control system of the instant tape printer, as described later in greater detail. When the dial 16 is positioned such that the indicia "あ.A" are aligned with the pointer 18 as indicated in FIG. 1, the states of the signals produced by the sensor 50 are "1" for both of the outer and inner rows 46, 48, as indicated in FIG. 4. This output "1, 1∞ of the sensor 50 is obtained only when the indicia "あ.A" are aligned with the pointer 18. In this position, the dial 16 is zeroed. If the next output of the sensor 50 obtained by an incremental rotation thereof from this zero point is "0, 0", this indicates that the dial 16 has been rotated in the clockwise direction as viewed in FIG. 1. If the next output is "0, 1", on the other hand, this means that the dial 16 has been rotated in the counterclockwise direction. Thus, the rotating direction of the dial 16 can be determined. Further, the angular phase of the dial 16 and therefore the indicia (characters) aligned with the pointer 18 can be determined by counting the pulse signals from the sensor 50 which correspond to the grids 44 and slits 45 on the slit disc 42.

As shown in FIG. 2, the CONFIRMATION key 20 is fitted in the annular character entry dial 16 such that the key 20 is axially slidable relative to the dial 16. While the key 20 is biased by a spring 54 in a direction that causes the key 20 to protrude from the dial 16, the key 20 is held in position by abutting contact of a tab 56 of the key 20 with the lower end portion of the dial 16. The CONFIRMATION key 20 has an elastically yieldable rubber contact plate 58 fixed to its lower end. A contactor 62 is disposed on a baseplate 60 of the data input section 10, such that the contactor 62 is located right below a central portion of the contact plate 58. The contact plate 58 also serves as a dust boot surrounding the contactor 62, and is rotatable while its lower end is held in contact with the surface of the baseplate 60. The function keys 36 indicated above have a construction similar to that of the CONFIRMATION key 20. Each function key 36 has a contactor 66 disposed between a corresponding contact plate 64 and the baseplate 60, so as to produce a signal when operated.

Figure 9:
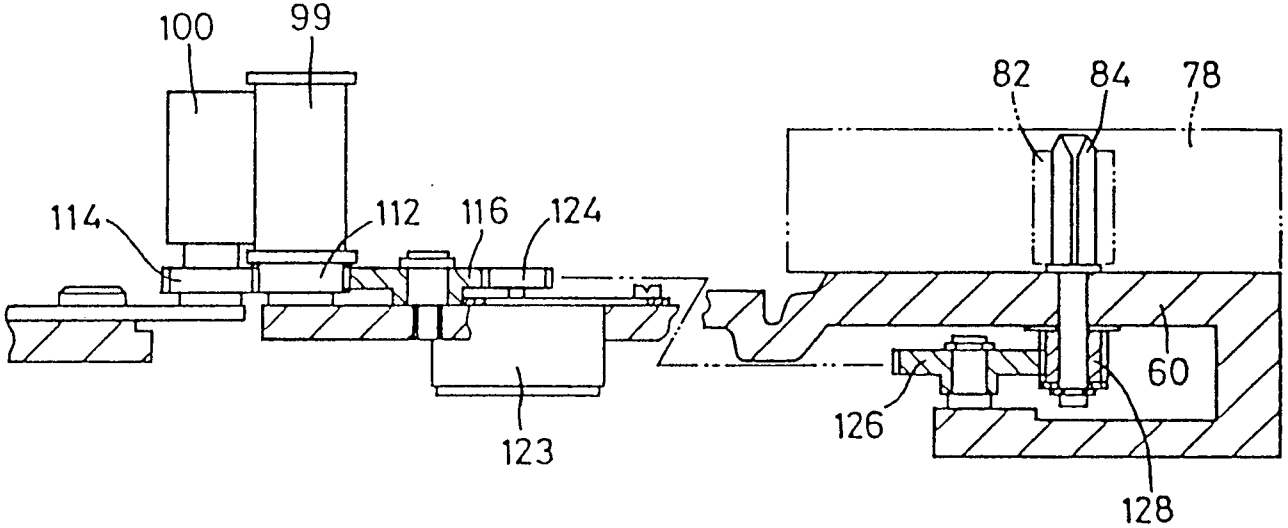
FIG. 9 is a view illustrating a drive system for feeding a transparent tape and an ink ribbon.

Referring back to FIG. 1, a recording tape in the form of a substantially transparent tape 70 (hereinafter simply called "transparent tape") is fed leftward (as viewed in FIG. 1) in its longitudinal direction, through the printing section 14. On this transparent tape 70, an image is printed by a recording device in the form of a thermal head 72. This thermal head 72 has a row of heat-generating elements (not shown) which extends in a direction normal to the direction of feed of the tape 70. The thermal head 72 is held in pressed contact with a medium feeding roller in the form of a platen roller 76, via the transparent tape 70 and an ink ribbon 74 which has an inking material. With the appropriate heat-generating elements of the thermal head 72 energized so as to form a corresponding character pattern, the inking material in the corresponding local portions of the ink ribbon 74 is transferred to the back surface of the transparent tape 70 while the tape 70 is fed in the leftward direction as seen in FIG. 1. In this manner, the image is printed on the back surface of the tape 70 such that the printed image as viewed in the direction toward the printed back surface is laterally reversed with respect to a nominal desired image as viewed in the direction toward the non-printed front surface. The platen roller 76 is supported rotatably about an axis which is parallel to the row of the heat-generating elements of the thermal head 72. The platen roller 76 is biased by a suitable biasing device in a direction toward the thermal head 72. A roll of the ink ribbon 74 is accommodated in a ribbon cassette 78. More specifically, the ink ribbon 74 is supplied from the roll mounted on a supply spool (not shown) in the ribbon cassette 78 as shown in FIG. 1, and is fed between the thermal head 72 and the platen roller 76. The used length of the ink ribbon 74 is rewound on a take-up spool 82 in the ribbon cassette 78, as shown in FIG. 9.

Figure 7:
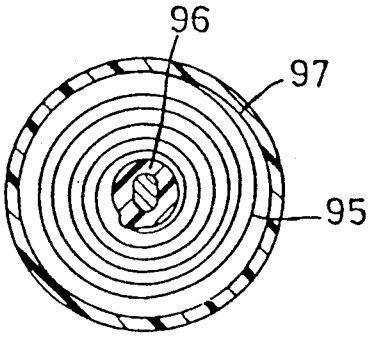
FIG. 7 is a cross sectional view taken along line VII—VII of FIG. 6.
Figure 6:
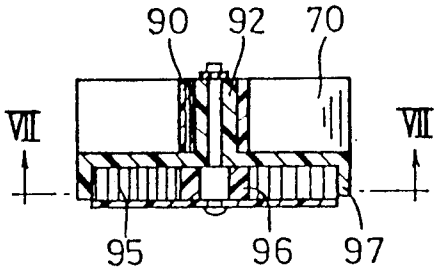
FIG. 6 is a cross sectional view showing a modification of the arrangement of FIG. 5.

The transparent tape 70 is wound as a roll on a supply spool 90. As is apparent from FIG. 5, the supply spool 90 is fit on a spool shaft 92 and is rotatable with the spool shaft 92. Between this spool shaft 92 and the base-plate 60 of the printing section 14, there is disposed a spring washer 94 which applies a suitable amount of resistance to the rotation of the spool 90, whereby a free rotation of the roll of the transparent tape 70 is avoided. Alternative means for applying a resistance to the rotation of the supply spool 90 is illustrated in FIGS. 6 and 7. This alternative means employs a spiral spring 95 which is fixed at its one end to a fixed member 96. The other end of the spiral spring 95 is pre-loaded in pressed contact with the inner surface of a cylindrical portion 97 formed as an intergral part of the spool shaft 92. A friction force between the spiral spring 95 and the surface of the rotating cylindrical portion 97 provides a resistance to the rotating movement of the supply spool 90.

Figure 5:
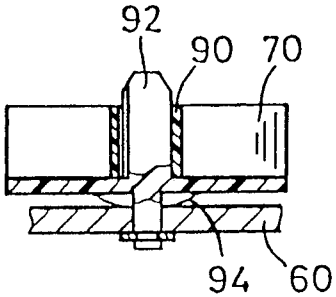
FIG. 5 is a cross sectional view taken along line V—V of FIG. 1.

In either of the two arrangements of FIG. 5 and FIGS. 6–7, the transparent tape 70 supplied from the supply spool 90 is turned by a guide roller 98 in its feed direction, and passes between the thermal head 72 and the platen roller 76. The portion of the transparent tape 70 on which the printing is effected by the thermal head 72 is further fed between a pair of mutually adjacently located presser rollers 99, 100 disposed downstream of the thermal head 72. The two presser rollers 99, 100 define therebetween a pressure nip through which is passed the printed portion of the tape 70 which bears the laterally reversed image.

A supply spool 104 is disposed on one of opposite sides of the ribbon cassette 78 which is remote from the supply spool 90 for the transparent tape 70. This supply spool 104 supports a roll of a release or backing tape 102. The supply spool 104 is fit on a spool shaft 106 for rotation therewith. Like the supply spool 90 for the transparent tape 70, the supply spool 104 is given a resistance to its rotation, by a mechanism similar to that shown in FIG. 5 or 6, whereby a free rotation of the roll of the backing tape 102 is avoided. The backing tape 102 supplied from the spool 104 is fed between the presser rollers 99, 100, so that the backing tape 102 adheres to the back surface of the printed portion of the transparent tape 70.

Figure 8:
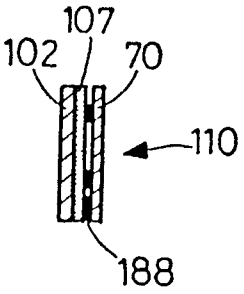
FIG. 8 is a cross sectional view showing a multi-layered tape produced by the tape printer.

As is apparent from FIG. 8, the backing tape 102 has an adhesive layer 107 formed on one of opposite surfaces thereof. The tape 102 is bonded at its adhesive layer 107 to the back surface of the printed portion of the tape 70, while the tapes 70, 102 are passed through the pressure nip of the presser rollers 99, 100.

The presser rollers 99, 100 have respective gears 112, 114 integrally and concentrically formed therewith, as shown in FIG. 9. The two gears 112, 114 are held in mesh with each other, for rotation with the rollers 99, 100. The gear 112 meshes with an intermediate gear 116, which engages with a pinion 124 secured to an output shaft of a tape feeding motor 123. With the motor 123 operated, the presser rollers 99, 100 are rotated in opposite directions, in pressed rolling contact with each other, to thereby feed the transparent tape 70 in the leftward direction as seen in FIG. 1, and bond the backing tape 102 to the transparent tape 70. In the present embodiment, the presser rollers 99, 100, tape feeding motor 123 and the gears 112, 114, 116 constitute a feeding device for feeding the transparent tape 70, and a device for covering the printed length of the tape 70 with the backing tape 102.

As indicated in FIG. 9, the pinion 124 of the tape feeding motor 123 is also connected to a gear 126 via the gear 116. The gear 126 meshes with a take-up gear 128 of the ribbon cassette 78, which gear 128 is concentrically fixed to a spool shaft 84 on which the take-up spool 82 is mounted. The take-up gear 128 is adapted to slip on the spool shaft 84 when a torque applied to the gear 128 exceeds a cetain value.

Downstream of the presser rollers 99, 100 as viewed in the feeding direction of the transparent tape 70, there is disposed a cutter mechanism generally indicated at 130 in FIGS. 1 and 10. The cutter mechanism 130 is adapted to cut a multi-layered tape 110 which consists of the printed transparent tape 70 and the backing tape 102 bonded to the tape 70. As shown in FIG. 10, the cutter mechanism 130 has a cutter holder 132 and a support plate 134 which are arranged such that the cutter holder 132 is on the side of the backing tape 102 while the support plate 134 is on the side of the transparent tape 70.

The cutter holder 132 is secured to a stationary block 133 fixed to the body of the printing section 14. A completely cutting blade 136 is fixed to an intermediate portion of the cutter holder 132, such that the blade 136 extends toward the backing tape 102 of the multi-layered tape 110. Further, two partially cutting blades 138, 140 are held by the cutter holder 132, on the upstream and downstream sides of the completely cutting blade 136 as viewed in the feeding direction of the tape 110, such that the blades 138, 140 extend toward the backing tape 102. The partially cutting blades 138, 140 are spaced a same distance on either side of the completely cutting blade 136 with respect to the feeding direction of the tape.

As indicated in FIG. 11, the partially cutting blades 138, 140 have a same projection H1 from the surface of the cutter holder 132. This projection H1 is determined so as to cut only the backing tape 102 which has a thickness t1. On the other hand, the completely cutting blade 136 has a projection H2 from the cutter holder 132. This projection H2 is determined so as to satisfy the following inequality:

$$H1+t2+t3 \leqq H2 < H1+t2+t3+d$$

where, t2: thickness of the adhesive layer 107 t3: thickness of the transparent tape 70 d: depth of a notch 156 formed in the support plate 134

Described differently, the cutting tip or edge of each partially cutting blade 138, 140 is spaced by a distance l ($l \geqq t2+t3$) from the cutting edge of the completely cutting blade 136 in the direction away from the backing tape 102, so that the partially cutting blades 138, 140 are able to cut only the backing tape 102. On the other hand, the completely cutting blade 136 is adapted to cut off the multi-layered tape 110, through its entire thickness which includes the thicknesses of the backing tape 102 and transparent tape 70.

A pair of presser members 142 are supported by the cutter holder 132 such that the two presser members 142 are located symmetrically with respect to the completely cutting blade 136, on the opposite sides of the cutter holder 132, in spaced-apart relation with each other in the direction of feed of the tape (110). The presser members 142 are movable in a direction perpendicular to the surface of the backing tape 102. Each presser member 142 is biased by a compression spring 144 in a direction toward the backing tape 102, and is provided with a flange portion 146 at its rear end. The fully advanced position of the presser member 142 is determined by abutting contact of the flange portion 146 with the cutter holder 132. An amount of projection of each presser member 142 from the cutter holder 132 is larger than the projection H2 of the completely cutting blade 136, but is determined so as to avoid an interference of the presser member 142 with the backing tape 102.

The support plate 134 is supported pivotally about a shaft 150 toward and away from the cutting blades 136, 138, 140 and presser members 142, in a plane perpendicular to the direction of width of the multi-layered tape 110. While the support plate 134 is biased by a tension spring 152 in a direction away from the cutting blades 136, 138, 140, the retracted position of the support plate 134 is determined by a stop 153. The support plate 134 has at its free end an integrally formed lever 154, which is manipulated to pivot the support plate 134. The support plate 134 has a notch 156 formed in its surface which faces the transparent tape 70. The notch 156 is located in alignment with an extension line of the completely cutting blade 136, when the support plate 134 is in the operated position. The notch 156 accommodates the end portion of the completely cutting blade 136.

The thus constructed support plate 134 cooperates with the pair of presser members 142 to sandwich and retain the appropriate portion of the multi-layered tape 110, and urge that portion of the tape 110 against cutting blades 136, 138, 140. Thus, the support plate 134 and the presser members 142 serve as a cutting-motion imparting mechanism for effecting a relative movement between the tape 110 and the cutting blades 136, 138, 140, i.e., for giving a cutting motion to the tape 110. The axis of pivot 150 of the support plate 134 is located so that the plate 134 is parallel to the tape 110 when the plate 134 is in the cutting position.

Figure 12:
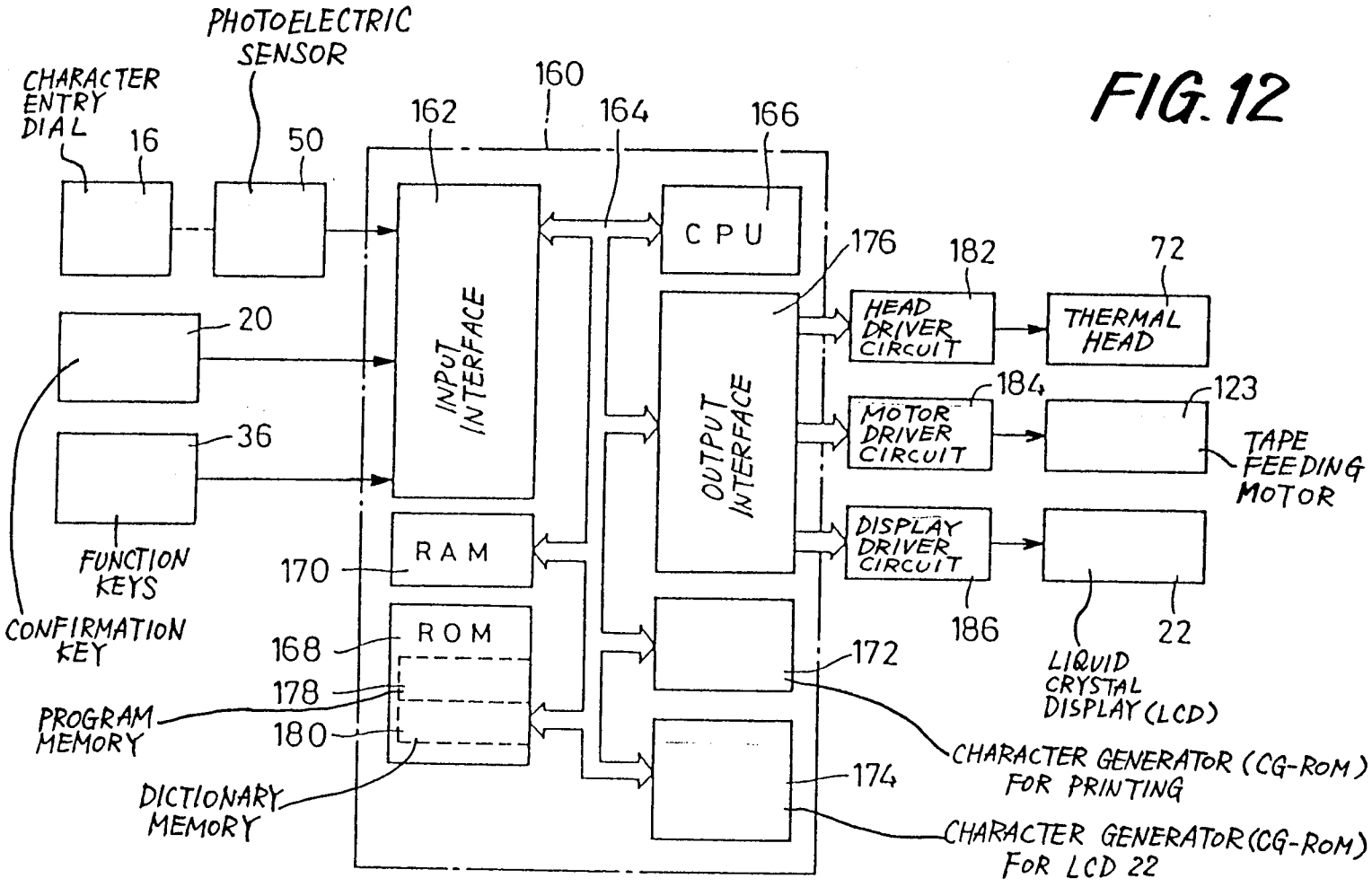
FIG. 12 is a schematic block diagram showing a control system of the tape printer of FIG. 1.

Referring next to the block diagram of FIG. 12, there is illustrated a control system for controlling the data input section 10 and printing section 14.

The photoelectric sensor 50 for detecting the angular position of the character entry dial 16, the CONFIRMATION key 20 for confirming the character selected by the dial 16, and the various function keys 36 are connected to an input interface 162 of a microcomputer 160. The input interface 162 is connected through a bus line 164 to a CPU (central processing unit) 166, a ROM (read-only memory) 168, a RAM (random-access memory) 170, character generators (hereinafter referred to as "CG-ROM") 172, 174, and an output interface 176.

The ROM 168 includes a PROGRAM memory 178 which stores a control program for controlling the operation of the instant tape printer, and a DICTIONARY memory 180 used for converting the "kana" words into the Chinese character words. The RAM 170 has various counters, registers and buffer memories. The CG-ROM 172 generates dot-matrix character patterns for printing characters, based on entered coded character data, and the CG-ROM 174 generates dot-matrix character patterns for displaying the characters on the liquid crystal display 22. To the output interface 176, there are connected a head driver circuit 182, a motor driver circuit 184 and a display driver circuit 186, which are connected to the thermal head 72, tape feeding motor 123 and liquid crystal display 22, respectively.

As described above, the thermal head 72 is disposed in the rear section of the tape printer, such that the heat-generating elements of the head 72 face the back surface of the transparent tape 70. The transparent tape 70 is fed in the leftward direction as viewed in FIG. 1. However, the tape 70 is fed in the rightward direction when viewed in the direction from the thermal head 72 toward the back surface of the tape 70. Therefore, the dot-matrix character pattern data is read out from the CG-ROM 172 in the same order as in an ordinary thermal printer. Namely, the dot-matrix data sets for each character are read out, beginning with the data set representative of the leftmost column of the character, whereby the heat-generating elements of the thermal head 72 are selectively energized according to the dot-matrix data sets. As a result, an appropriate image is printed on the back surface of the transparent tape 70 (which faces the thermal head 72), such that the printed image as viewed in the direction toward the back surface of the tape 70 is laterally reversed with respect to a nominal desired image as viewed in the direction toward the non-printed front surface of the tape 70. Although the dot-matrix pattern data per se fed to the thermal head 72 and the order of reading of the data are the same as in an ordinary thermal printer for printing the nominal image (non-reversed image), the image printed by the thermal head 72 is laterally reversed, since the direction of feed of the tape 70 as viewed on the side of the thermal head 72 is reversed with respect to the tape feeding direction in the ordinary thermal printer.

In the present embodiment, the thermal head 72 having the heat-generating elements, platen roller 76, and microcomputer 160 for controlling the thermal head 72 constitute a printing mechanism for printing on the transparent tape 70.

There will next be described the operation of the instant tape printer.

After the tape printer is turned on, the character entry dial 16 is zeroed by pressing the CONFIRMATION key 20 while the indicia "ぁ.A" on the dial 16 are aligned with the pointer 18. Subsequently, the CPU 166 processes various signals.

To enter each desired character, the dial 16 is rotated to the appropriate angular position, and the OUT/IN selector key 25 is operated to designate one of the two rows of indicia in which the appropriate character indium is provided. Then, the CONFIRMATION key 20 is operated. As a result, the corresponding character data is fed to the microcomputer 160. The selected character aligned with the pointer 18 is displayed on the liquid crystal display 22, via the CG-ROM 174. Simultaneously, the dot-matrix character pattern data of the character to be printed is generated from the CG-ROM 172 and is stored in a print buffer (not shown) of the RAM 170. Upon operation of the PRINT key 35, the dot-matrix character pattern data is retrieved from the print buffer, and fed to the thermal head 72, whereby the corresponding image is printed on the transparent tape 70 such that the printed image as viewed in the direction toward the printed back surface of the tape 70 is laterally reversed to the nominal image as viewed in the direction toward the non-printed front surface of the tape 70. Since the operator sees the printed image as the normal nominal image, the operator can easily confirm the printed image.

During the printing operation, the presser rollers 99, 100 are rotated in the opposite directions while sandwiching the transparent tape 70. Accordingly, the tape 70 is pulled from the supply spool 90, and is fed past the thermal head 72 in timed relation with the printing action of the head 72. At the same time, the backing tap 102 is pulled from the supply spool 104. The platen roller 76 which is biased toward the thermal head 72 for pressed contact with the thermal head 72 via the tape 70, is rotated due to a friction force between the roller 76 and the tape 70 being fed.

As indicated in FIG. 1, the presser roller 99 has guide flanges at its upper and lower ends, which serve to guide the tapes 70, 102, such that the upper and lower edges of the tapes contact the flanges. Thus, the tapes 70, 102 can be properly positioned in the direction of width. The circumferential surface between the two flanges of the presser roller 99 cooperates with the other presser roller 100 to nip and feed the tapes 70, 102.

The presser rollers 99, 100, which serve to feed the tapes 70, 102, also function as a major part of the backing device for backing the printed tape 70 with the backing tape 102. Described more specifically, the transparent tape 70 and the backing tape 102 are superposed on each other by the rotating movements of the presser rollers 99, 100, and the backing tape 102 is bonded at its adhesive layer 107 to the printed back surface of the tape 70. Thus, the multi-layered tape 110 indicated above is produced. The laterally reversed image printed on the back surface of the tape 70 is indicated at 188 in FIG. 8.

The obtained multi-layered tape 110 is further fed by the rotating movements of the presser rollers 99, 100, to the cutter mechanism 130 of FIG. 10 disposed downstream of the rollers 99, 100. After the tape 110 is fed between the presser members 142 and the support plate 134 by a suitable distance, the tape feeding motor 123 is turned off and the feeding of the tape 110 is stopped. Described more specifically, the motor 123 is turned off by the CPU 166 of the microcomputer 160, when a part of the tape 110 a predetermined length spaced away from the last imprint on the transparent tape 70 reaches a cutting position aligned with the completely cutting blade 136.

In this condition, the operating lever 154 is operated in the clockwise direction as viewed in FIG. 10, against the biasing force of the tension spring 152. Consequently, the tape 110 is completely severed by the completely cutting blade 136, from the backing tape 102 to the transparent tape 70. Simultaneously, the backing tape 102 is cut by the partially cutting blades 138, 140. Namely, partial cuts 190, 192 are formed through the thickness of the backing tape 102, as indicated in FIG. 13. These partial cuts 190, 192 facilitate the removal of the backing tape 102.

After the tape 110 is cut, the support plate 134 is returned to the original retracted position under the biasing action of the tension spring 152, and the presser members 142 are restored to their original position under the biasing action of the compression springs 144. Thus, the tape 110 is released from the cutter mechanism 130. In this condition, the tape 110 can be fed again.

With the leading end portion of the tape 110 cut by the cutter mechanism 130 as described above, a cut segment 194 as indicated in FIG. 13 is obtained. This cut segment 194 has two partial cuts 192, 196 adjacent to its opposite ends. Described more particularly, with one cutting operation by the cutter mechanism 130, the segment 194 is separated from the tape 110 by a complete cut 198 through the entire thickness of the tape 110, by the completely cutting blade 136. Simultaneously, the partial cuts 190, 192 through the backing tape 102 are produced by the partially cutting blades 138, 140, on both sides of the complete cut 198. The cut 190 produced by the partially cutting blade 138 shown in FIG. 13 is provided in the leading end portion 200 of the tape 110, which is cut off as a cut segment in the next cutting operation. The partial cut 196, which corresponds to cut 190 during the cutting action, in the cut segment 194 was produced by the partially cutting blade 138 in the preceding cutting operation.

Figure 14:
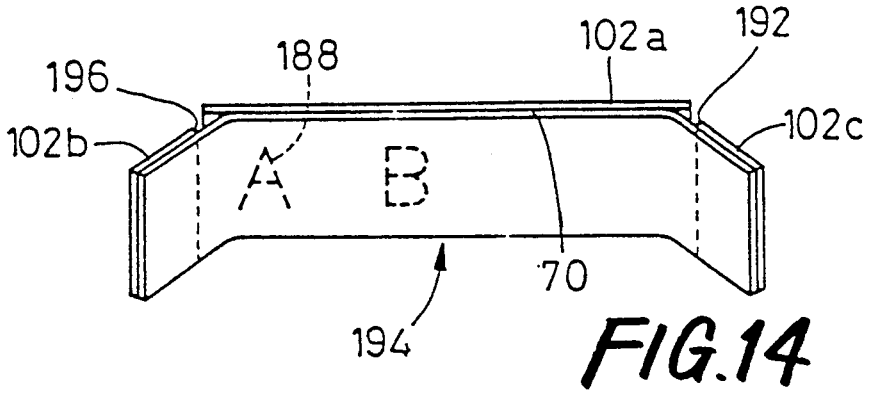
FIG. 14 is a view explaining the removal of a backing tape from the cut segment of FIG. 13.
Figure 15:
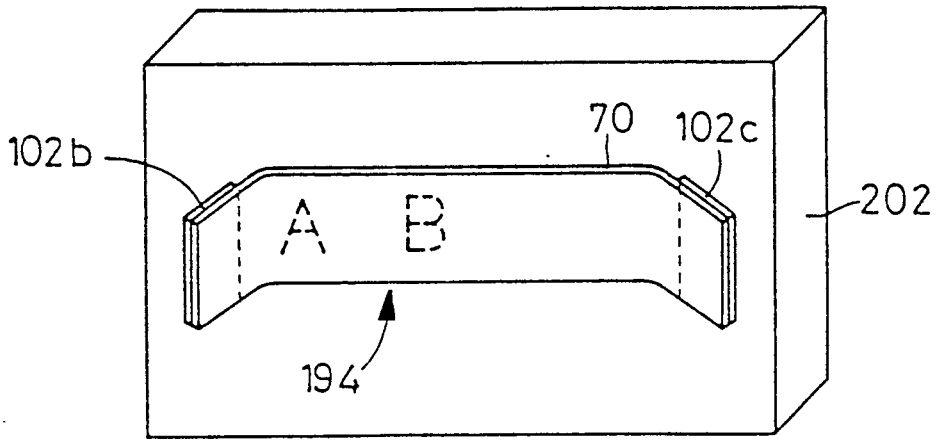
FIG. 15 is a view explaining the manner in which the cut segment is bonded to an object surface.
Figure 16:
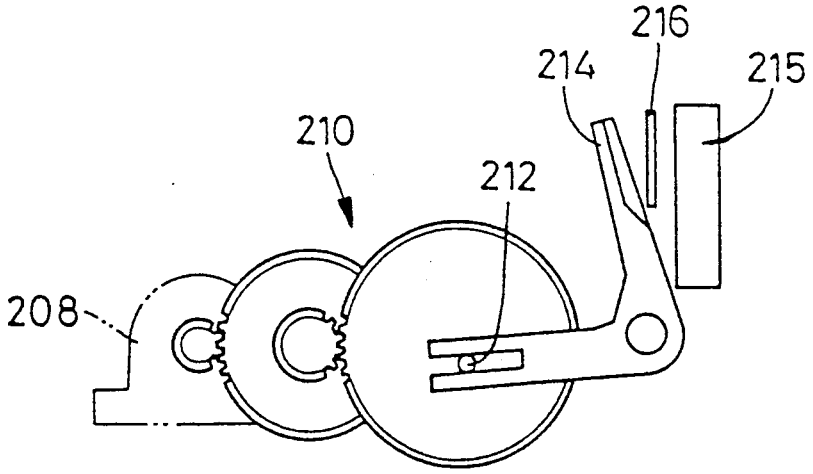
FIG. 16 PRIOR ART
FIG. 16 is a view showing a cutter mechanism conventionally used in a tape printer.

The thus prepared cut segment 194 is bonded to a suitable object 202 (FIG. 15), with the backing tape 102 removed, such that the printed image 188 is seen as the desired nominal image as viewed in the direction toward the surface of the object, as indicated in FIGS. 14 and 15. That is, the cut segment 194 is finger-gripped at its opposite end portions and is flexed so that the ends of an intermediate portion 102*a* of the backing tape 102 are separated from the adhesive layer 107. The intermediate portion 102*a* may be easily removed, by finger-gripping one of the separated ends. Then, the cut segment 194 is stretched and positioned on the object surface, with its end portions finger-gripped, while the exposed portion of the adhesive layer 107 is held slightly above the surface of the object 202, as shown in FIG. 15. In the next step, the exposed portion of the adhesive layer 107 is forced against the object surface, and the remaining end portions 102*b*, 102*c* of the backing tape 102 are removed. Since the intermediate portion of the cut segment 194 is already bonded to the object surface, there is no possibility of the segment 194 being shifted out of position when the exposed end portions of the adhesive layer 107 are bonded to the object surface. Thus, the positioning of the cut segment 194 on the object surface can be accomplished without the fingers contacting the adhesive layer 107, and the segment 194 can be completely bonded to the object surface with substantially no contact of the fingers with the adhesive layer 107.

In the above embodiment, the cutter mechanism 130 employs the two partially cutting blades 138, 140 provided on both sides of the completely cutting blade 136. However, only one partially cutting blade may be provided on one side of the completely cutting blade 136, so that a single cut through the backing tape 102 is formed in one end part or central part of the cut segment or in the leading end portion of the tape 110. In this case, too, the removal of the backing tape 102 is facilitated.

Further, the cutter mechanism 130 which uses the stationary cutting blades 136, 138, 140 and the support plate 134 may be replaced by a cutting arrangement wherein cutting blades are moved along desired cutting lines, to cut the printed multi-layered tape.

While the multi-layered tape 110 consists of the transparent tape 70 and the backing tape 102 bonded to the tape 70 through the adhesive layer 107, the instant tape printer may be modified to produce a multi-layered tape which consists of the transparent tape 70, an opaque base tape bonded to the printed surface of the tape 70, and the backing tape 102 bonded to the base tape. In this case, too, the partially cutting blades 138, 140 are adapted to cut only the backing tape 102. Further, a desired nominal image is printed on a front surface of a transparent tape or a paper or other opaque tape whose back surface is covered by a backing tape before or after the printing is effected. In this case, too, the backing tape is cut by the partially cutting blade or blades of the cutter mechanism.

Further, the principle of the present invention is also applicable to various types of tape printer which uses a print head other than the thermal print head, for example to a tape printer using a dot-matrix impact print head which employs print wires. It will be understood that the invention may be embodied with other changes, modifications and improvements which may occur to those skilled in the art, in the light of the foregoing disclosure.

What is claimed is:

1. A recording apparatus, comprising:

a printing device for printing on a recording tape;

a tape feeding device for feeding a multi-layered tape in the longitudinal direction of said multi-layered tape, said multi-layered tape including a printed length of said recording tape printed by said printing device, and a backing tape superimposed on said printed length via an adhesive layer provided therebetween; and a cutter mechanism for cutting said multi-layered tape into cut segments, said cutter mechanism comprising a completely cutting blade disposed so as to face said backing tape of said multi-layer tape, for cutting said multi-layered tape through an entire thickness thereof to thereby provide complete cuts which divide said multi-layered tape into said cut segments, and two partially cutting blades disposed on opposite sides of said completely cutting blade, respectively, so as to face said backing tape, in a spaced-apart relation with each other in a direction of feed of said multi-layered tape, to cut only said backing tape, wherein when said completely cutting blade executes two successive cuts of said multi-layered tape through the entire thickness thereof, there are two partial cuts in said backing tape on said cut segment thereby dividing the backing tape into three separate parts on said cut segment, wherein a center part of said divided backing tape may be removed and end parts of said divided backing tape provide gripping means for aligning and initially mounting the cut segments.

2. A recording apparatus according to claim 1, wherein each of said two partially cutting blades has a cutting edge which is spaced from the cutting edge of said completely cutting blade in a direction away from said backing tape, so that said each partially cutting plate cuts only said backing tape when said completely cutting blade cuts said multi-layered tape through the entire thickness thereof, and wherein said cutter mechanism further comprises:

a cutter holder for supporting said completely cutting blade and said two partially cutting blades such that said completely and partially cutting blades are immovable relative to each other; and a cutting motion imparting mechanism for effecting a relative movement between said cutter holder and said multi-layered tape, to thereby cause said completely cutting blade and said two partially cutting blades to concurrently cut said multi-layered tape and said backing tape, respectively, such that after two successive cutting-motions said two partial cuts are formed in said backing tape on each of said cut segments.

3. A recording apparatus according to claim 2, wherein said cutting-motion imparting mechanism comprises a support member disposed on one of opposite sides of said multi-layered tape remote from said cutter holder, said support member and said cutting holder being movable toward each other to move said cutter holder and said multi-layered tape toward each other such that said support member supports said multi-layered tape on said one side of the multi-layered tape, when said completely and partially cutting blades cut said multi-layered tape and said backing tape, respectively.

4. A recording apparatus according to claim 3, wherein said cutter holder is a stationary member, while said support member is a member which is supported pivotally about an axis perpendicular to said direction of feed of said multi-layered tape, so as to move toward said cutter holder.

5. A recording apparatus according to claim 3, wherein said cutting-motion imparting mechanism further comprises:

biasing means for biasing the support member in a direction away from said cutter holder; and an operating member for moving said support member toward said cutter holder against a biasing action of said biasing means.

6. A recording apparatus according to claim 3, wherein said cutting-motion imparting means further comprises:

presser means which is supported by said cutter holder such that said presser means acts on said multi-layered tape at two positions which are located upstream and downstream of said completely and partially cutting blades, said presser means being movable between an advanced position thereof in which said presser means protrudes a larger distance than said blades toward said multi-layered tape, and a retracted position thereof in which said presser means protrudes a smaller distance than said blades; and biasing means for biasing said presser means toward said advanced position, said presser means urging said multi-layered tape against said support member at said two positions, prior to cutting of said multi-layered tape and said backing tape by said support member and said completely and partially cutting blades.

7. A recording apparatus according to claim 1, wherein said partially cutting blades are spaced apart from said completely cutting blade by a same distance on either side of said completely cutting blade in relation to said direction of feed of the multi-layered tape.

8. A recording apparatus according to claim 1, wherein said tape feeding device comprises a drive source for feeding said multi-layered tape, and control means for controlling said drive source so as to feed said multi-layered tape in said direction of feed until a part of said multi-layered tape a predetermined length spaced away from a last character printed on said recording tape in said direction of feed reaches a cutting position aligned with said completely cutting blade, said control means turning off said drive source when said part of said multi-layered tape reaches said cutting position.

9. A recording apparatus according to claim 1, further comprising means for superposing said backing tape having said adhesive layer affixed on one side thereof onto the printed length of said recording tape such that a surface of said recording tape on which a printing is effected by said printing device is covered by said adhesive layer of said backing tape.

10. A recording apparatus, comprising:

a printing device for printing on a recording tape in a longitudinal direction of said recording tape;

means for superposing a backing tape with an adhesive layer on a printed length of said recording tape printed by said printing device, to thereby provide a multi-layered tape, such that a surface of said recording tape on which a printing is effected by said printing device is covered by said adhesive layer of said backing tape;

a tape feeding device for feeding said multi-layered tape in a longitudinal direction of said multi-layered tape which is parallel to said longitudinal direction of said recording tape; and a cutting mechanism for cutting said multi-layered tape into cut segments such that each of said cut segments has a partial cut formed through only a thickness of said backing tape at a position near each end of said cut segment so as to divide said backing tape into a center part and two end parts, wherein said center part may be first removed and said end parts provide gripping means for aligning and initially mounting the cut segment;

said tape feeding device comprising an electrically operated drive source for feeding said multi-layered tape, and control means for controlling said electrically operated drive source so as to feed said multi-layered tape in said longitudinal direction thereof until a part of said multi-layered tape a predetermined length spaced away from a last character printed on said recording tape in said longitudinal direction thereof reaches a cutting position aligned with said cutter mechanism, said control means turning off said electrically operated drive source when said part of said multi-layered tape reaches said cutting position.

11. A recording apparatus according to claim 10, wherein said printing device includes a non-impact print head having at least one printing element which acts on said recording tape.

12. A recording apparatus according to claim 11, wherein said non-impact print head consists of a thermal print head having at least one heat-generating element.

13. A recording apparatus according to claim 10, wherein said printing device is adapted to print an image on a surface of a recording tape which comprises a transparent tape on which said backing tape is superposed, such that said image as viewed in a direction facing the printed surface of said transparent tape is laterally reversed to a nominal image as viewed in a direction facing a non-printed surface of said transparent tape.

14. A recording apparatus according to claim 13, further comprising means for forming an adhesive layer on said backing tape, wherein said backing tape is superposed on said printed surface of the printed length of said transparent tape such that said printed surface is covered by said adhesive layer.

* * * * *